US008062432B2

(12) United States Patent
Sugawara et al.

(10) Patent No.: US 8,062,432 B2
(45) Date of Patent: Nov. 22, 2011

(54) CLEANING METHOD FOR TURBO MOLECULAR PUMP

(75) Inventors: Eiichi Sugawara, Nirasaki (JP); Tsuyoshi Moriya, Nirasaki (JP)

(73) Assignee: Tokyo Electron Limited, Tokyo (JP)

( * ) Notice: Subject to any disclaimer, the term of this patent is extended or adjusted under 35 U.S.C. 154(b) by 836 days.

(21) Appl. No.: 12/053,880

(22) Filed: Mar. 24, 2008

(65) Prior Publication Data

US 2008/0236629 A1 Oct. 2, 2008

Related U.S. Application Data

(60) Provisional application No. 60/947,510, filed on Jul. 2, 2007.

(30) Foreign Application Priority Data

Mar. 30, 2007 (JP) ..... 2007-092380

(51) Int. Cl.
*B08B 9/00* (2006.01)

(52) U.S. Cl. ..... 134/22.1; 134/1; 134/8; 134/19; 134/22.18

(58) Field of Classification Search ..... 134/1–1.3, 134/17, 21, 22.1, 22.18, 32, 37
See application file for complete search history.

(56) References Cited

U.S. PATENT DOCUMENTS

| | | | | |
|---|---|---|---|---|
| 4,089,702 | A * | 5/1978 | Enoksson et al. | 134/1 |
| 4,707,951 | A * | 11/1987 | Gibot et al. | 451/99 |
| 5,151,135 | A * | 9/1992 | Magee et al. | 134/1 |
| 5,531,862 | A * | 7/1996 | Otsubo et al. | 438/798 |
| 5,795,399 | A * | 8/1998 | Hasegawa et al. | 134/1.3 |
| 5,931,721 | A * | 8/1999 | Rose et al. | 451/89 |
| 6,074,486 | A * | 6/2000 | Yang et al. | 118/719 |
| 6,095,158 | A * | 8/2000 | Shugrue | 134/1 |
| 6,098,637 | A * | 8/2000 | Parke | 134/1.1 |
| 6,410,408 | B1 * | 6/2002 | Yano | 438/484 |
| 6,461,437 | B1 * | 10/2002 | Kubota et al. | 118/719 |
| 2002/0006766 | A1 * | 1/2002 | Haerle et al. | 451/39 |
| 2005/0261120 | A1 * | 11/2005 | Li | 501/1 |
| 2006/0260366 | A1 * | 11/2006 | Slutsky et al. | 68/3 R |

FOREIGN PATENT DOCUMENTS

JP 2007-180467 7/2007

* cited by examiner

*Primary Examiner* — Michael Barr
*Assistant Examiner* — Caitlin N Dennis
(74) *Attorney, Agent, or Firm* — Oblon, Spivak, McClelland, Maier & Neustadt, L.L.P.

(57) ABSTRACT

A cleaning method for a turbo molecular pump, which enables the exhausting ability of the turbo molecular pump to be restored without bringing about a decrease in the productivity of a substrate processing apparatus. A vaporizing gas that vaporizes foreign matter attached to an internal surface of the turbo molecular pump is supplied toward the foreign matter.

7 Claims, 12 Drawing Sheets

CLEANING METHOD FOR TURBO MOLECULAR PUMP

BACKGROUND OF THE INVENTION

1. Field of the Invention

The present invention relates to a cleaning method for a turbo molecular pump, and in particular to a cleaning method for a turbo molecular pump connected to a processing chamber of a substrate processing apparatus.

2. Description of the Related Art

Conventionally, substrate processing apparatuses that carry out predetermined processing on substrates such as wafers for semiconductor devices have a processing chamber (hereinafter referred to merely as the "chamber") in which a substrate is housed and subjected to predetermined processing. In such a substrate processing apparatus, a highly-reactive gas is usually introduced as a processing gas into the chamber. If the highly-reactive gas remains in the chamber, when the chamber communicates with another chamber, the highly-reactive gas remaining in the chamber may diffuse into the other chamber and cause a trouble. Moreover, in the chamber, particles arising from deposit attached to an inner wall of the chamber and reaction product produced during predetermined processing are floating. If these floating particles become attached to surfaces of substrates, a short circuit will occur in products such as semiconductor devices manufactured from the substrates, resulting in the yield of the semiconductor devices decreasing. To remove the highly-reactive gas and the particles from the chamber, the substrate processing apparatus exhausts gas out of the chamber using an exhaust system.

As shown in FIG. 12A, the exhaust system of the substrate processing apparatus has a turbo molecular pump (hereinafter referred to as the "TMP") 60 that is an exhausting pump capable of achieving a high vacuum state. The TMP 60 has a rotary shaft 61 that is disposed in a vertical direction as viewed in the drawing, that is, along an exhaust stream, a cylindrical main body 62 that is disposed parallel to the rotary shaft 61 such as to house the rotary shaft 61, a plurality of rotary blades 63 projecting out at right angles from the rotary shaft 61, and a plurality of stationary blades 64 projecting out from an inner peripheral surface of the main body 62 toward the rotary shaft 61. The rotary blades 63 rotate about the rotary shaft 61 at high speed, whereby gas in front of the rotary blades 63 is exhausted to the rear of the rotary blades 63 at high speed. The exhaust system exhausts gas out of the chamber by operating the TMP 60 (see, for example, Japanese Laid-Open Patent Publication (Kokai) No. 2007-180467).

The gas exhausted out of the chamber by the exhaust system (hereinafter referred to as the "exhaust gas") contains a highly-reactive gas and particles, and hence when the exhaust gas passes through the interior of the TMP 60, foreign matter P is deposited on or becomes attached to an internal surface of the TMP 60. Specifically, the highly-reactive gas deposits reaction product on the internal surface of the TMP 60 when passing through the interior of the TMP 60, and the particles in the exhaust gas collide with and become attached to the internal surface of the TMP 60. When the foreign matter P is deposited on or becomes attached to the internal surface of the TMP 60, an exhaust space $S_2$ becomes smaller than a normal exhaust space $S_1$, as shown in FIG. 12B, and hence the exhausting ability of the TMP 60 decreases.

Moreover, the foreign matter P deposited on or attached to the internal surface of the TMP 60 emits gas, and hence the TMP 60 exhausts the gas emitted from the foreign matter P as well as the gas in the chamber. Thus, the flow rate of the gas exhausted out of the chamber relatively decreases, and hence the exhausting ability of the TMP 60 for the gas in the chamber decreases.

It should be noted that when the foreign matter P separates from the internal surface of the TMP 60, it may collide with the rotary blades 63 of the TMP 60 and recoil to flow back directly into the chamber. Thus, the foreign matter P may cause particles to arise in the chamber.

Conventionally, if the exhausting ability of a TMP has decreased, the exhausting ability of the TMP is restored by detaching the TMP from the exhaust system and replacing it with a new TMP.

However, because the replacing operation takes much time, the substrate processing apparatus has to be stopped for a long time, resulting in the productivity of the substrate processing apparatus decreasing.

SUMMARY OF THE INVENTION

The present invention provides a cleaning method for a turbo molecular pump, which enables the exhausting ability of the turbo molecular pump to be restored without bringing about a decrease in the productivity of a substrate processing apparatus.

Accordingly, in a first aspect of the present invention, there is provided a cleaning method for a turbo molecular pump connected to a processing chamber of a substrate processing apparatus, comprising a vaporizing gas supplying step of supplying a vaporizing gas that vaporizes foreign matter attached to an internal surface of the turbo molecular pump toward the foreign matter.

According to the first aspect of the present invention, because the vaporizing gas is supplied toward the foreign matter, the foreign matter chemically reacts with the vaporizing gas and vaporizes. The vaporized foreign matter is exhausted out of the turbo molecular pump by an exhaust stream inside the turbo molecular pump. As a result, the foreign matter can be removed from the internal surface of the turbo molecular pump, and hence the exhausting ability of the turbo molecular pump can be restored. For this reason, it is unnecessary to restore the exhausting ability of the turbo molecular pump by replacing the turbo molecular pump. Thus, the exhausting ability of the turbo molecular pump can be restored without bringing about a decrease in the productivity of the substrate processing apparatus.

The first aspect of the present invention can provide a cleaning method, wherein the vaporizing gas is the same type of gas as a processing gas supplied into the processing chamber.

According to the first aspect of the present invention, because the same type of gas as the processing gas supplied into the processing chamber is supplied as the vaporizing gas, the construction of a detoxifying device connected to the downstream side of the turbo molecular pump can be simplified.

The first aspect of the present invention can provide a cleaning method, wherein the vaporizing gas is ozone gas.

According to the first aspect of the present invention, the ozone gas is supplied as the vaporizing gas. If the foreign matter is comprised of a fluorocarbon-based polymer, the fluorocarbon-based polymer chemically reacts with the ozone gas and decomposes into oxygen gas, fluorine gas, carbon dioxide gas, carbon monoxide gas, and so on, and hence the foreign matter comprised of the fluorocarbon-based polymer can be reliably vaporized.

The first aspect of the present invention can provide a cleaning method, wherein the vaporizing gas supplying step comprises an ultraviolet irradiation step of irradiating ultraviolet rays toward the foreign matter.

According to the first aspect of the present invention, the ultraviolet rays are irradiated toward the foreign matter. When the ultraviolet rays are irradiated toward the foreign matter to which the ozone gas has been supplied, hydroxyl radicals are generated to chemically react with the foreign matter. As a result, the vaporization of the foreign matter can be promoted.

The first aspect of the present invention can provide a cleaning method, wherein the vaporizing gas supplying step comprises a hydrogen-containing gas supplying step of supplying a hydrogen-containing gas containing hydrogen toward the foreign matter.

According to the first aspect of the present invention, the hydrogen-containing gas containing hydrogen is supplied toward the foreign matter. Even if the interior of the turbo molecular pump is in a vacuum, the hydroxyl radicals can thus be reliably generated.

Accordingly, in a second aspect of the present invention, there is provided a cleaning method for a turbo molecular pump connected to a processing chamber of a substrate processing apparatus, comprising a shock wave producing step of producing shock waves that propagate toward foreign matter attached to an internal surface of the turbo molecular pump.

According to the second aspect of the present invention, because the shock waves that propagate toward the foreign matter are produced, the foreign matter is caused to separate from the interior of the turbo molecular pump by the shock waves. The separated foreign matter is exhausted out of the turbo molecular pump by an exhaust stream inside the turbo molecular pump. As a result, the foreign matter can be removed from the internal surface of the turbo molecular pump, and hence the same effects as those in the cleaning method for the turbo molecular pump according to the above described first aspect can be obtained.

The second aspect of the present invention can provide a cleaning method, wherein in the shock wave producing step, a predetermined gas is supplied at a supersonic speed.

According to the second aspect of the present invention, the predetermined gas is supplied into the interior of the turbo molecular pump at a supersonic speed. As a result, the shock waves can be reliably produced in the interior of the turbo molecular pump.

The second aspect of the present invention can provide a cleaning method, wherein the predetermined gas is a high-temperature gas.

According to the second aspect of the present invention, the high-temperature gas is supplied as the predetermined gas. As a result, the foreign matter attached to the internal surface of the turbo molecular pump can be separated therefrom through thermal stress.

The second aspect of the present invention can provide a cleaning method, wherein the predetermined gas is a water vapor-containing gas containing water vapor.

According to the second aspect of the present invention, the water vapor-containing gas containing water vapor is supplied as the predetermined gas. Thus, water vapor penetrates through the foreign matter to which the water vapor-containing gas has been supplied, and the penetrated water vapor is cooled at a boundary between the foreign matter and the internal surface of the turbo molecular pump and liquefies, whereby the attachment force of the foreign matter attached to the internal surface of the turbo molecular pump can be decreased. The foreign matter whose attachment force has been decreased can be separated by micro-cavitation that occurs when the water vapor is supplied. That is, when the water vapor-containing gas is supplied at high speed, a micro bubble produced through vaporization of a low-pressure portion of the water vapor-containing gas is crushed and disappears within a very short period of time, and a lifting force arising from a very high pressure produced on that occasion acts on the foreign matter.

Accordingly, in a third aspect of the present invention, there is provided a cleaning method for a turbo molecular pump connected to a processing chamber of a substrate processing apparatus, comprising a vibrating step of vibrating the turbo molecular pump at a predetermined vibration frequency.

According to the third aspect of the present invention, because the turbo molecular pump vibrates at a predetermined vibration frequency, the foreign matter is caused to separate from the internal surface of the turbo molecular pump by the vibrations. The separated foreign matter is exhausted out of the turbo molecular pump by an exhaust stream inside the turbo molecular pump. As a result, the foreign matter can be removed from the internal surface of the turbo molecular pump, and hence the same effects as those in the cleaning method for the turbo molecular pump according to the above described first aspect can be obtained.

The third aspect of the present invention can provide a cleaning method, wherein the predetermined vibration frequency is a natural vibration frequency of foreign matter attached to an internal surface of the turbo molecular pump.

According to the third aspect of the present invention, the turbo molecular pump vibrates at a natural vibration frequency of the foreign matter attached to the internal surface of the turbo molecular pump. As a result, resonance of the foreign matter can be produced, and hence the foreign matter can be reliably separated from the internal surface of the turbo molecular pump.

Accordingly, in a fourth aspect of the present invention, there is provided a cleaning method for a turbo molecular pump connected to a processing chamber of a substrate processing apparatus and having an internal surface on which a photocatalyst is formed, comprising an ultraviolet irradiating step of irradiating ultraviolet rays toward the internal surface of the turbo molecular pump to which foreign matter is attached.

According to the fourth aspect of the present invention, because the ultraviolet rays are irradiated toward the internal surface of the turbo molecular pump on which a photocatalyst is formed and to which the foreign matter is attached, hydroxyl radicals are generated from the photocatalyst formed on the internal surface of the turbo molecular pump to which the foreign matter is attached, and the foreign matter chemically reacts with the hydroxyl radicals and vaporizes. The vaporized foreign matter is exhausted out of the turbo molecular pump by an exhaust stream inside the turbo molecular pump. As a result, the foreign matter can be removed from the internal surface of the turbo molecular pump, and hence the same effects as those in the cleaning method for the turbo molecular pump according to the above described first aspect can be obtained.

Accordingly, in a fifth aspect of the present invention, there is provided a cleaning method for a turbo molecular pump connected to a processing chamber of a substrate processing apparatus, comprising an electromagnetic wave irradiating step of irradiating electromagnetic waves toward foreign matter attached to an internal surface of the turbo molecular pump.

According to the fifth aspect of the present invention, because the electromagnetic waves are irradiated toward the foreign matter, the foreign matter absorbs the electromagnetic waves and generates heat. When the temperature of the foreign matter rises to a sublimation point, the foreign matter vaporizes. The vaporized foreign matter is exhausted out of the turbo molecular pump by an exhaust stream inside the turbo molecular pump. As a result, the foreign matter can be removed from the internal surface of the turbo molecular pump, and hence the same effects as those in the cleaning method for the turbo molecular pump according to the above described first aspect can be obtained.

Accordingly, in a sixth aspect of the present invention, there is provided a cleaning method for a turbo molecular pump connected to a processing chamber of a substrate processing apparatus, comprising a laser light irradiating step of irradiating laser light toward foreign matter attached to an internal surface of the turbo molecular pump.

According to the sixth aspect of the present invention, because the laser light is irradiated toward the foreign matter, the foreign matter is heated by the laser light. When the temperature of the foreign matter rises to a sublimation point, the foreign matter vaporizes. The vaporized foreign matter is exhausted out of the turbo molecular pump by an exhaust stream inside the turbo molecular pump. As a result, the foreign matter can be removed from the internal surface of the turbo molecular pump, and hence the same effects as those in the cleaning method for the turbo molecular pump according to the above described first aspect can be obtained.

Accordingly, in a seventh aspect of the present invention, there is provided a cleaning method for a turbo molecular pump connected to a processing chamber of a substrate processing apparatus, comprising a cleaning fluid flowing step of flowing a cleaning fluid into the turbo molecular pump.

According to the seventh aspect of the present invention, because the cleaning fluid is flown into the turbo molecular pump, the foreign matter is caused to separate from the internal surface of the turbo molecular pump by the cleaning fluid. As a result, the foreign matter can be removed from the internal surface of the turbo molecular pump, and hence the same effects as those in the cleaning method for the turbo molecular pump according to the above described first aspect can be obtained.

The seventh aspect of the present invention can provide a cleaning method, wherein the cleaning fluid flowing step comprises a vibration applying step of applying vibrations to the cleaning fluid.

According to the seventh aspect of the present invention, because the vibrations are applied to the cleaning fluid, the foreign matter can be reliably separated from the internal surface of the turbo molecular pump.

Accordingly, in an eighth aspect of the present invention, there is provided a cleaning method for a turbo molecular pump connected to a processing chamber of a substrate processing apparatus, comprising a brushing step of scrubbing foreign matter attached to an internal surface of the turbo molecular pump using a brush.

According to the eighth aspect of the present invention, because the foreign matter is scrubbed by the brush, the foreign matter separates from the internal surface of the turbo molecular pump. The separated foreign matter is exhausted out of the turbo molecular pump by an exhaust stream inside the turbo molecular pump. As a result, the foreign matter can be removed from the internal surface of the turbo molecular pump, and hence the same effects as those in the cleaning method for the turbo molecular pump according to the above described first aspect can be obtained.

Accordingly, in a ninth aspect of the present invention, there is provided a cleaning method for a turbo molecular pump connected to a processing chamber of a substrate processing apparatus, comprising a mixture jetting step of jetting a mixture in which a substance in gaseous form and a substance that is the same as the substance and is in one or both of liquid form and solid form are mixed toward foreign matter attached to an internal surface of the turbo molecular pump.

According to the ninth aspect of the present invention, because the mixture is jetted toward the foreign matter, the foreign matter is caused to separate from the internal surface of the turbo molecular pump by viscous force of the substance in gaseous form in the mixture, impact force of the substance in one or both of liquid form and solid form of the mixture, and lifting force that is produced when the substance in one or both of liquid form and solid form sublimes between the foreign matter and the internal surface of the turbo molecular pump. The separated foreign matter is exhausted out of the turbo molecular pump by an exhaust stream inside the turbo molecular pump. As a result, the foreign matter can be removed from the internal surface of the turbo molecular pump, and hence the same effects as those in the cleaning method for the turbo molecular pump according to the above described first aspect can be obtained.

The ninth aspect of the present invention can provide a cleaning method comprising a heating step of heating the turbo molecular pump before the mixture jetting step.

According to the ninth aspect of the present invention, the turbo molecular pump is heated before the mixture is jetted toward the foreign matter. As a result, the foreign matter can be reliably separated from the internal surface of the turbo molecular pump due to a difference in volume change caused by heat shrink between the internal surface of the turbo molecular pump and the foreign matter that has been cooled by the jetted mixture.

Accordingly, in a tenth aspect of the present invention, there is provided a cleaning method for a turbo molecular pump connected to a processing chamber of a substrate processing apparatus, comprising a radical supplying step of supplying radicals toward foreign matter attached to an internal surface of the turbo molecular pump.

According to the tenth aspect of the present invention, because the radicals are supplied toward the foreign matter, the foreign matter chemically reacts with the radicals and vaporizes. The vaporized foreign matter is exhausted out of the turbo molecular pump by an exhaust stream inside the turbo molecular pump. As a result, the foreign matter can be removed from the internal surface of the turbo molecular pump, and hence the same effects as those in the cleaning method for the turbo molecular pump according to the above described first aspect can be obtained.

The features and advantages of the invention will become more apparent from the following detailed description taken in conjunction with the accompanying drawings.

BRIEF DESCRIPTION OF THE DRAWINGS

FIGS. 2A and 2B are views useful in explaining a cleaning process as the cleaning method for the turbo molecular pump according to the present embodiment, in which FIG. 2A shows a case where the turbo molecular pump has a vaporizing gas supply device, and FIG. 2B shows a case where the turbo molecular pump has a vaporizing gas supply device and an ultraviolet irradiation device;

FIGS. 5A and 5B are views useful in explaining a third variation of the cleaning process according to the present embodiment, in which FIG. 5A shows a case where the turbo molecular pump has an ultraviolet irradiation device, and FIG. 5B is an enlarged view of a portion B shown in FIG. 5A;

FIGS. 6A and 6B are views useful in explaining a fourth variation of the cleaning process according to the present embodiment, in which FIG. 6A shows a case where the turbo molecular pump has an electromagnetic wave irradiation device, and FIG. 6B is an enlarged view of a portion B shown in FIG. 6A;

FIGS. 7A and 7B are views useful in explaining a fifth variation of the cleaning process according to the present embodiment, in which FIG. 7A shows a case where the turbo molecular pump has a laser light irradiation device, and FIG. 7B is an enlarged view of a portion B shown in FIG. 7A;

FIGS. 10A and 10B are views useful in explaining an eighth variation of the cleaning process according to the present embodiment, in which FIG. 10A shows a case where the turbo molecular pump has an aerosol jetting device, and FIG. 10B is an enlarged view of a portion B shown in FIG. 10A;

FIGS. 12A and 12B are views useful in explaining a state of an internal surface of the turbo molecular pump to which foreign matter is attached, in which FIG. 12A is a sectional view of the turbo molecular pump, and FIG. 12B is an enlarged view of a portion B shown in FIG. 12A.

DETAILED DESCRIPTION OF THE PREFERRED EMBODIMENTS

The present invention will now be described in detail with reference to the drawings showing a preferred embodiment thereof.

First, a description will be given of a substrate processing apparatus to which a cleaning method for a turbo molecular pump according to an embodiment of the present invention is applied.

Figure 1:
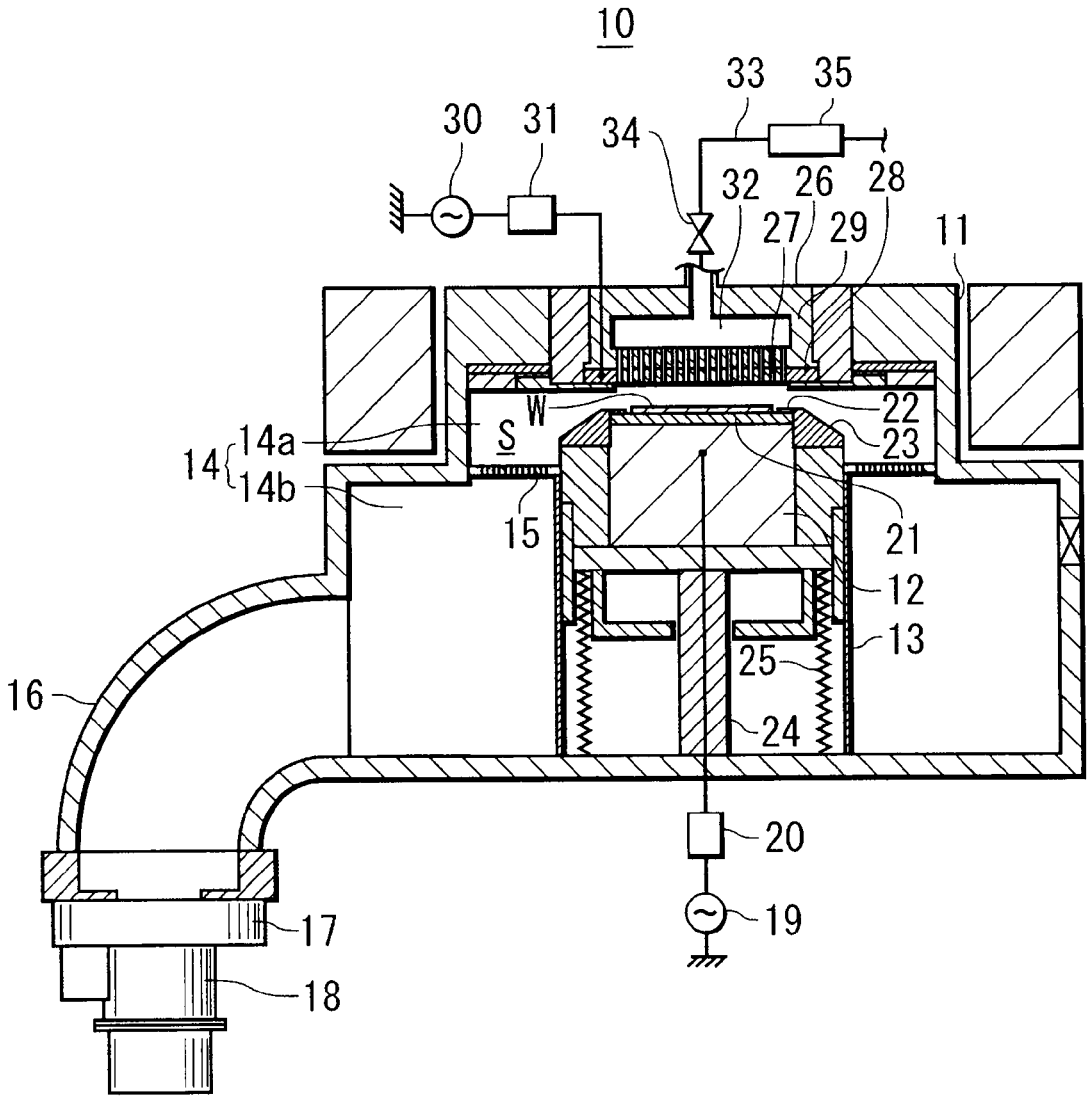
FIG. 1 is a sectional view schematically showing the construction of a substrate processing apparatus to which a cleaning method for a turbo molecular pump according to an embodiment of the present invention is applied.

FIG. 1 is a sectional view schematically showing the construction of the substrate processing apparatus to which the cleaning method for the turbo molecular pump according to the present embodiment is applied.

As shown in FIG. 1, the substrate processing apparatus 10 is constructed as an etching processing apparatus that carries out reactive ion etching (hereinafter referred to as the "RIE") processing on a wafer W for a semiconductor device (hereinafter referred to merely as a "wafer W"). The substrate processing apparatus 10 has a chamber 11 comprised of two large and small stacked cylinders made of metal such as aluminum or stainless steel.

A lower electrode 12 as a wafer stage on which is mounted a wafer W having a diameter of, for example, 300 mm and which rises and falls in the chamber 11 together with the mounted wafer W, and a cylindrical cover 13 that covers the side of the lower electrode 12 that rises and falls are disposed in the chamber 11. An exhaust path 14 that acts as a flow path through which gas is exhausted out of the chamber 11 is formed between an inner side wall of the chamber 11 and the side face of the lower electrode 12 or the cover 13.

An annular exhaust plate 15 that partitions the exhaust path 14 into an upstream side portion 14*a* and a downstream portion 14*b* is disposed part way along the exhaust path 14. The lower side portion 14*b* communicates with a TMP 18, which is an exhaust pump for evacuation, via an exhaust manifold 16 as a communicating pipe and an adaptive pressure control (hereinafter referred to as the "APC") valve 17, which is a variable slide valve. A dry pump (not shown) is connected to the downstream side of the TMP 18. It should be noted that the APC valve 17 may be a butterfly valve.

Figure 2A:
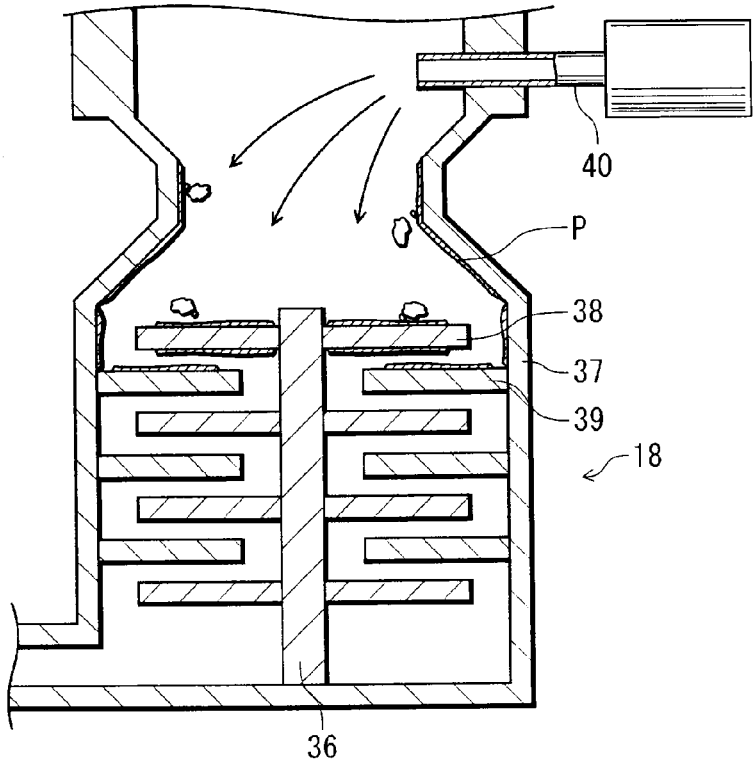

The TMP 18 has a rotary shaft 36 disposed in a vertical direction as viewed in FIG. 2A, that is, along an exhaust stream, a cylindrical main body 37 disposed parallel to the rotary shaft 36 such as to house the rotary shaft 36, a plurality of rotary blades 38 projecting out at right angles from the rotary shaft 36, and a plurality of stationary blades 39 projecting out from an inner peripheral surface of the main body 37 toward the rotary shaft 36.

The plurality of rotary blades 38 project out radially from the rotary shaft 36 to form a rotary blade group, and the plurality of stationary blades 39 are arranged at regular intervals on the same circumference of the inner peripheral surface of the main body 37 and project out toward the rotary shaft 36 to form a stationary blade group. In the TMP 18, there are a plurality of rotary blade groups and a plurality of stationary blade groups. The rotary blade groups are disposed at regular intervals along the rotary shaft 36, and the stationary blade groups are disposed between the adjacent two rotary blade groups.

The TMP 18 rotates the rotary blades 38 about the rotary shaft 36 at high speed, so that gas in an upper portion of the TMP 18 is exhausted toward a lower portion of the TMP 18 at high speed.

The TMP 18 is operated in collaboration with the dry pump to reduce the pressure in the chamber 11 down to a substantially vacuum state, and the APC valve 17 controls the pressure in the chamber 11 when the pressure in the chamber 11 is reduced.

The above described exhaust path 14, exhaust plate 15, exhaust manifold 16, APC valve 17, TMP 18, and dry pump together constitute an exhaust system.

Referring again to FIG. 1, a lower radio frequency power source 19 is connected to the lower electrode 12 via a lower matcher 20. The lower radio frequency power source 19 applies predetermined radio frequency electrical power to the lower electrode 12. The lower matcher 20 reduces reflection of the radio frequency electrical power from the lower electrode 12 so as to maximize the efficiency of the supply of the radio frequency electrical power into the lower electrode 12.

An ESC 21 for attracting a wafer W through electrostatic attracting force is disposed in an upper portion of the lower electrode 12. A DC power source (not shown) is electrically connected to an electrode plate (not shown) disposed in the ESC 21. The wafer W is attracted to and held on an upper surface of the ESC 21 through a Coulomb force or a Johnsen-Rahbek force produced due to a DC voltage applied from the DC power source to the electrode plate. Moreover, an annular focus ring 22 made of silicon (Si) or the like is provided on a peripheral portion of the ESC 21. The focus ring 22 focuses ions and radicals produced above the lower electrode 12 toward the wafer W. A peripheral portion of the focus ring 22 is covered with an annular cover ring 23.

A support 24 extended downward from a lower portion of the lower electrode 12 is disposed under the lower electrode 12. The support 24 supports the lower electrode 12 and lifts and lowers the lower electrode 12 by turning a ball screw (not shown). Also, a peripheral portion of the support 24 is covered with a bellows cover 25 so as to be cut off from an atmosphere in the chamber 11.

In the substrate processing apparatus 10, when a wafer W is to be transferred into or out from the chamber 11, the lower electrode 12 is lowered to a transfer position for the wafer W, and when the wafer W is to be subjected to the RIE processing, the lower electrode 12 is lifted to a processing position for the wafer W.

A shower head 26 that supplies a processing gas, described later, into the chamber 11 is disposed in a ceiling portion of the chamber 11. The shower head 26 has a disk-shaped upper electrode 28 having therein a number of gas vent holes 27 facing a processing space S above the lower electrode 12, and an electrode support 29 that is disposed on an upper portion of the upper electrode 28 and on which the upper electrode 28 is detachably supported.

An upper radio frequency power source 30 is connected to the upper electrode 28 via an upper matcher 31. The upper radio frequency power source 30 applies predetermined radio frequency electrical power to the upper electrode 28. The upper matcher 31 reduces reflection of the radio frequency electrical power from the upper electrode 28 so as to maximize the efficiency of the supply of the radio frequency electrical power into the upper electrode 28.

A buffer chamber 32 is provided inside the electrode support 29. A processing gas introducing pipe 33 is connected to the buffer chamber 32. A valve 34 is disposed part way along the processing gas introducing pipe 33, and a filter 35 is disposed upstream of the valve 34. A processing gas comprised of, for example, silicon tetrafluoride ($SiF_4$), oxygen gas ($O_2$), argon gas (Ar), and carbon tetrafluoride (CF4) singly or in combination is introduced from the processing gas introducing pipe 33 into the buffer chamber 32, and the introduced processing gas is supplied into the processing space S via the gas vent holes 27.

In the chamber 11 of the plasma processing apparatus 10, radio frequency electrical power is applied to the lower electrode 12 and the upper electrode 28, and the processing gas is turned into high-density plasma in the processing space S through the applied radio frequency electrical power, so that ions and radicals are produced. The produced ions and radicals are focused onto the front surface of the wafer W by the focus ring 27, whereby the front surface of the wafer W is physically/chemically etched.

Moreover, in the substrate processing apparatus 10, reaction product produced during the etching and floating in the chamber 11, and particles arising from deposit attached to an inner wall of the chamber 11 as well as gas in the chamber 11 are exhausted out of the chamber 11 by the exhaust system.

In general, the processing gas supplied into the chamber 11 is a highly-reactive gas, and hence the gas exhausted out of the chamber 11 by the exhaust system (hereinafter referred to as the "exhaust gas") contains a highly-reactive gas and particles. Thus, when the exhaust gas passes through the interior of the TMP 18, particles P are deposited on or become attached to an internal surface of the main body 37 and surfaces of the rotary blades 38, stationary blades 39, and rotary shaft 36 (hereinafter referred to as the "internal surface of the TMP 18") (FIG. 2A), resulting in the exhausting ability of the TMP 18 decreasing.

To cope with this, in the substrate processing apparatus 10 of the present embodiment, the exhausting ability of the TMP 18 is restored by carrying out a cleaning process as the cleaning method for the turbo molecular pump, described later.

A description will now be given of the cleaning method for the turbo molecular pump according to the present embodiment.

Figure 2B:
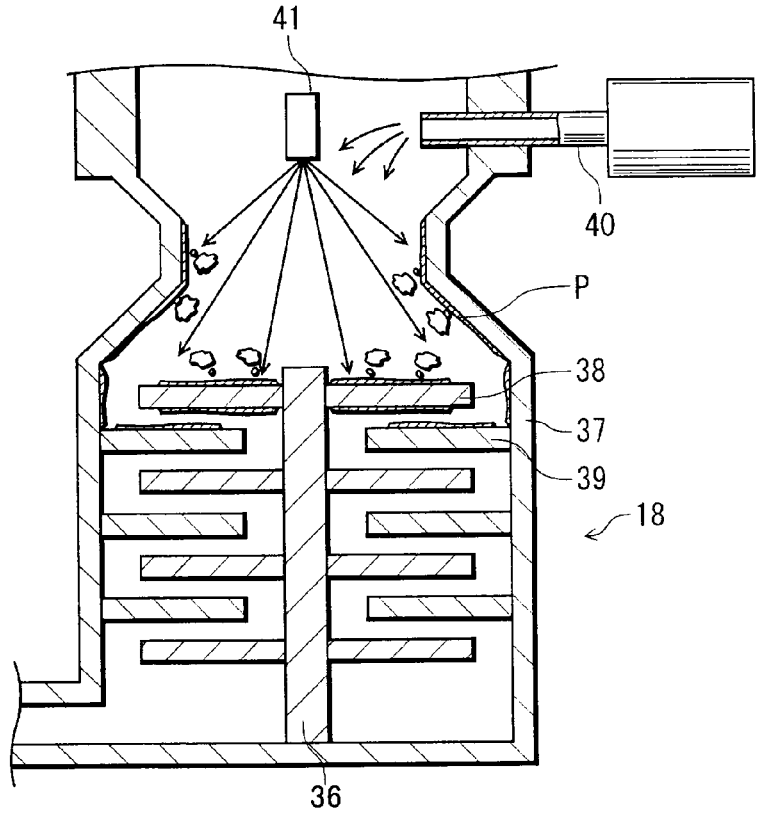

FIGS. 2A and 2B are views useful in explaining the cleaning process as the cleaning method for the turbo molecular pump according to the present embodiment, in which FIG. 2A shows a case where the TMP has a vaporizing gas supply device, and FIG. 2B shows a case where the TMP has a vaporizing gas supply device and an ultraviolet irradiation device. It should be noted that the present process is carried out, for example, between a certain production lot in which etching processing is carried out on a predetermined number of wafers and the subsequent production lot, or after the substrate processing apparatus 10 has continued idling for long hours in a case where foreign matter P becomes attached to the internal surface of the TMP 18 to bring about a decrease in the exhausting ability of the TMP 18.

As shown in FIG. 2A, the TMP 18 has a vaporizing gas supply device 40 that is disposed in an upper portion of the interior of the main body 37 and supplies a vaporizing gas that vaporizes foreign matter P attached to the internal surface of the TMP 18 toward the foreign matter P, and the vaporizing gas supply device 40 supplies the vaporizing gas toward the foreign matter P. When the vaporizing gas is supplied from the vaporizing gas supply device 40 toward the foreign matter P, the foreign matter P chemically reacts with the vaporizing gas and vaporizes, and the vaporized foreign matter P is exhausted out of the TMP 18 by the exhaust stream inside the TMP 18.

According to the present process, because the vaporizing gas is supplied to the foreign matter P, the foreign mater P reacts with the vaporizing gas and vaporizes. The vaporized foreign matter P is exhausted out of the TMP 18 by the exhaust stream inside the TMP 18. As a result, the foreign matter P can be removed from the internal surface of the TMP 18, and hence the exhausting ability of the TMP 18 can be restored. For this reason, it is unnecessary to restore the exhausting ability of the TMP 18 by replacing the TMP 18. Thus, the exhausting ability of the TMP 18 can be restored without bringing about a decrease in the productivity of the substrate processing apparatus 10.

Moreover, in the present process, if the foreign matter P is comprised of a fluorocarbon-based polymer, the vaporizing gas supply device 40 supplies ozone gas as the vaporizing gas. In this case, the fluorocarbon-based polymer chemically reacts with the ozone gas and decomposes into oxygen gas, fluorine gas, carbon dioxide gas, carbon monoxide gas, and so on, and hence the foreign matter P comprised of the fluorocarbon-based polymer can be reliably vaporized.

Moreover, in the present process, if the vaporizing gas supply device 40 supplies ozone gas, the TMP 18 may be equipped with an ultraviolet irradiation device 41 as shown in FIG. 2B. In this case, when the ultraviolet irradiation device 41 irradiates ultraviolet rays toward the foreign matter P to which the ozone gas has been supplied, hydroxyl radicals are generated to chemically react with the foreign matter P. As a result, the vaporization of the foreign matter P can be promoted. It should be noted that, if the interior of the TMP 18 is in a vacuum, it is preferred that a hydrogen-containing gas containing hydrogen, for example, a hydrogen gas as well as the ozone gas is supplied from the vaporizing gas supply device 40. This enables hydroxyl radicals to be reliably generated.

It should be noted that the ozone gas is highly reactive with a chemical compound having an —SH group, =S group, —$NH_2$ group, ═N group, H group, N group, —OH group, or —CHO group, and is thus particularly useful when foreign matter P comprised of such a chemical compound is attached to the internal surface of the TMP 18.

Moreover, in the present process, if the foreign matter P is comprised of silicon dioxide, the vaporizing gas supply device 40 supplies a hydrogen fluoride gas as the vaporizing gas. In this case, the silicon dioxide chemically reacts with the hydrogen fluoride gas and decomposes into water and silicon tetrafluoride gas, and hence the foreign matter P comprised of the silicon dioxide can be vaporized.

Moreover, in the present process, the vaporizing gas supply device 40 may supply ammonia gas, chlorine gas, or the like as the vaporizing gas according to the constituent material of the foreign matter P.

Moreover, in the present process, it is preferred that the vaporizing gas supplied from the vaporizing gas supply device 40 is the same type of gas as the processing gas supplied into the chamber 11. In this case, the construction of a detoxifying device connected to the downstream side of the dry pump can be simplified.

Next, a description will be given of variations of the cleaning process according to the present embodiment.

Figure 3:
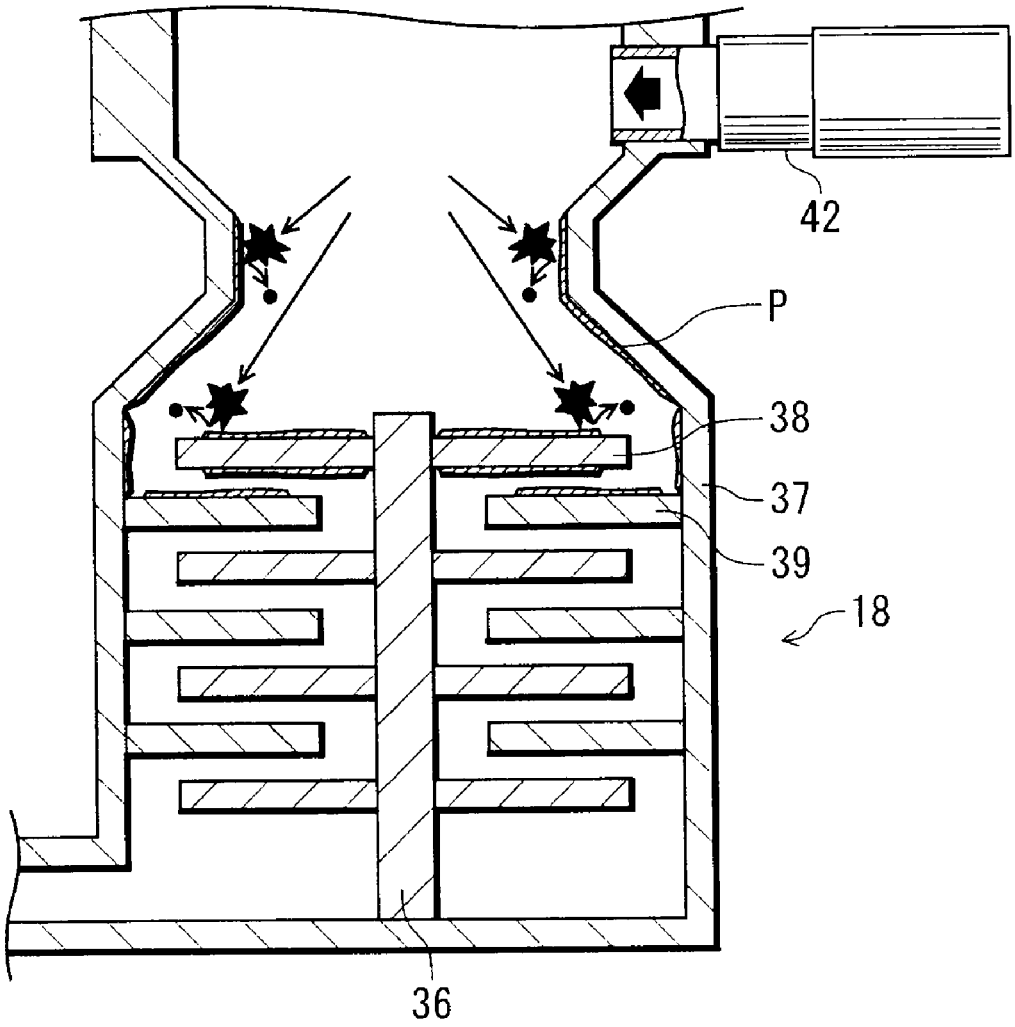
FIG. 3 is a view useful in explaining a first variation of the cleaning process according to the present embodiment.

FIG. 3 is a view useful in explaining a first variation of the cleaning process according to the present embodiment.

As shown in FIG. 3, the TMP 18 has a shock wave producing device 42 that is disposed in an upper portion of the interior of the main body 37 and produces shock waves that propagate toward foreign matter P attached to the internal surface of the TMP 18, and the shock wave producing device 42 produces the shock waves that propagate toward the foreign matter P. When the shock waves that propagate toward the foreign matter P are produced, the foreign matter P is caused to separate from the internal surface of the TMP 18 by the shock waves, and the separated foreign matter P is exhausted out of the TMP 18 by the exhaust stream inside the TMP 18.

According to the present process, because the shock waves that propagate toward the foreign matter P are produced, the foreign matter P is caused to separate from the internal surface of the TMP 18 by the shock waves. The separated foreign matter P is exhausted out of the TMP 18 by the exhaust stream inside the TMP 18. As a result, the foreign matter P can be removed from the internal surface of the TMP 18, and hence the same effects as those in the cleaning process described above with reference to FIG. 2A can be obtained.

In the present process, the shock wave producing device 42 supplies a predetermined gas into the TMP 18 at a supersonic speed. Thus, the shock waves can be reliably produced inside the TMP 18.

Moreover, in the present process, if the foreign matter P is comprised of silicon dioxide, it is preferred that the shock wave producing device 42 supplies hydrogen fluoride gas and ammonia gas as the predetermined gas. In this case, the silicon dioxide chemically reacts with the hydrogen fluoride gas and the ammonia gas and turns into $(NH_4)_2SiF_6$. Because the $(NH_4)_2SiF_6$ is comprised of powdery crystals, it can be easily separated from the internal surface of the TMP 18 by the shock waves.

Moreover, in the present process, it is preferred that the shock wave producing device 42 supplies a high-temperature gas as the predetermined gas. In this case, the foreign matter P attached to the internal surface of the TMP 18 can be separated therefrom through thermal stress.

Moreover, in the present process, it is preferred that the shock wave producing device 42 supplies a water vapor-containing gas as the predetermined gas. In this case, water vapor penetrates through the foreign matter P to which the water vapor-containing gas has been supplied, and the penetrated water vapor is cooled at a boundary between the foreign matter P and the internal surface of the TMP 18 and liquefies, whereby the attachment force of the foreign matter P attached to the internal surface of the TMP 18 can be decreased. The foreign matter P whose attachment force has been decreased can be separated from the internal surface of the TMP 18 through micro-cavitation that occurs when the water vapor is supplied. Specifically, when the water vapor-containing gas is supplied at high speed, a micro bubble produced through vaporization of a low-pressure portion of the water vapor-containing gas is crushed and disappears within a very short period of time, and a lifting force arising from a very high pressure produced on that occasion acts on the foreign matter P.

Figure 4:
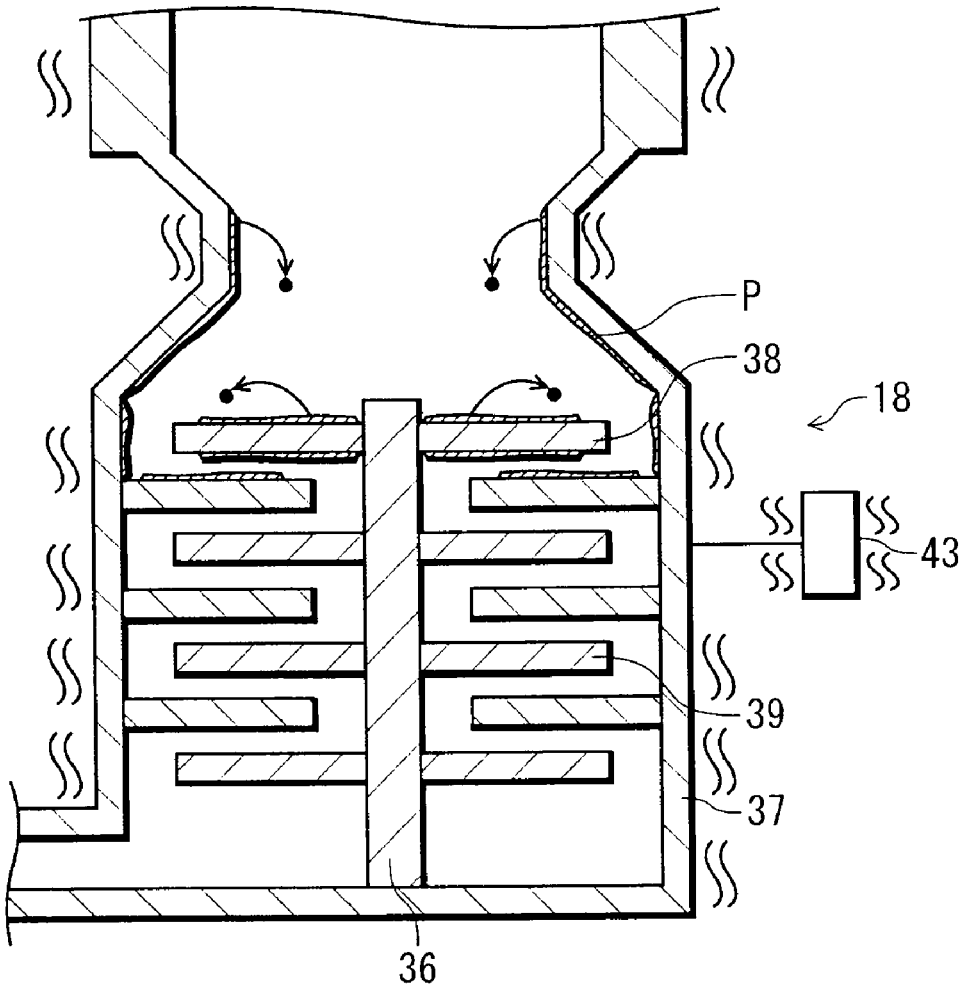
FIG. 4 is a view useful in explaining a second variation of the cleaning process according to the present embodiment.

FIG. 4 is a view useful in explaining a second variation of the cleaning process according to the present embodiment.

As shown in FIG. 4, the TMP 18 has a vibrating device 43 that vibrates the TMP 18 at a predetermined vibration frequency, and the vibrating device 42 vibrates the TMP 18 at a predetermined vibration frequency. When the TMP 18 vibrates at a predetermined vibration frequency, the foreign matter P is caused to separate from the internal surface of the TMP 18 by the vibrations, and the separated foreign matter P is exhausted out of the TMP 18 by the exhaust stream inside the TMP 18.

According to the present process, because the TMP 18 vibrates at a predetermined vibration frequency, the foreign matter P is caused to separate from the internal surface of the TMP 18 by the vibrations. The separated foreign matter P is exhausted out of the TMP 18 by the exhaust stream inside the TMP 18. As a result, the foreign matter P can be removed from the internal surface of the TMP 18, and hence the same effects as those in the cleaning process described above with reference to FIG. 2A can be obtained.

In the present process, it is preferred that the vibrating device 43 vibrates the TMP 18 at a natural vibration frequency of the foreign matter P attached to the internal surface of the TMP 18. In this case, resonance of the foreign matter P can be produced, and hence the foreign matter P can be reliably separated from the internal surface of the TMP 18.

Figure 5A:
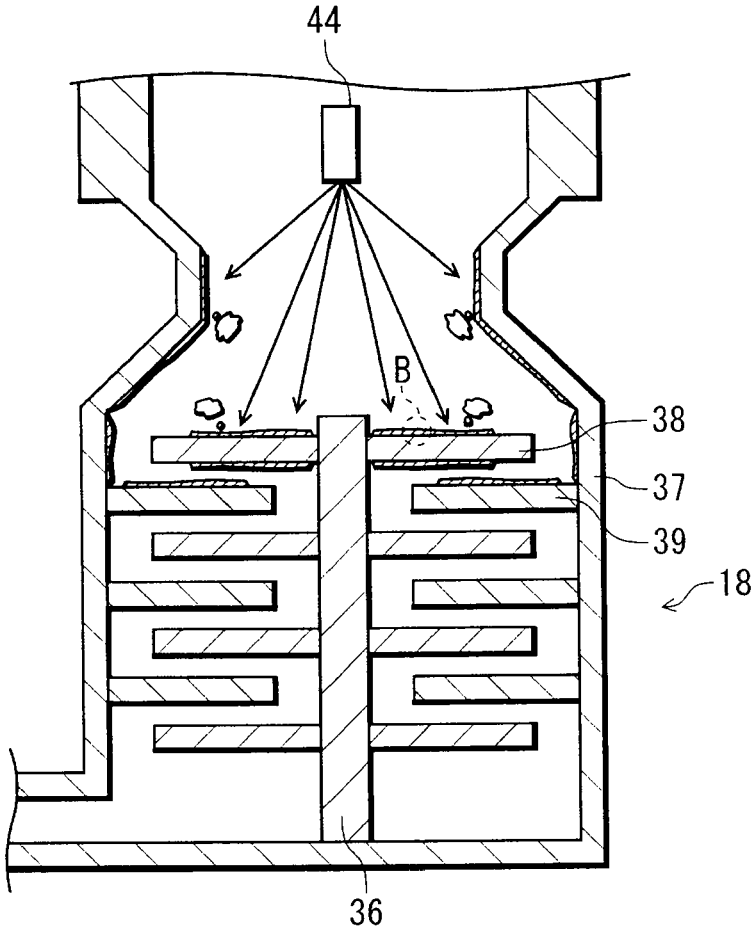
Figure 5B:
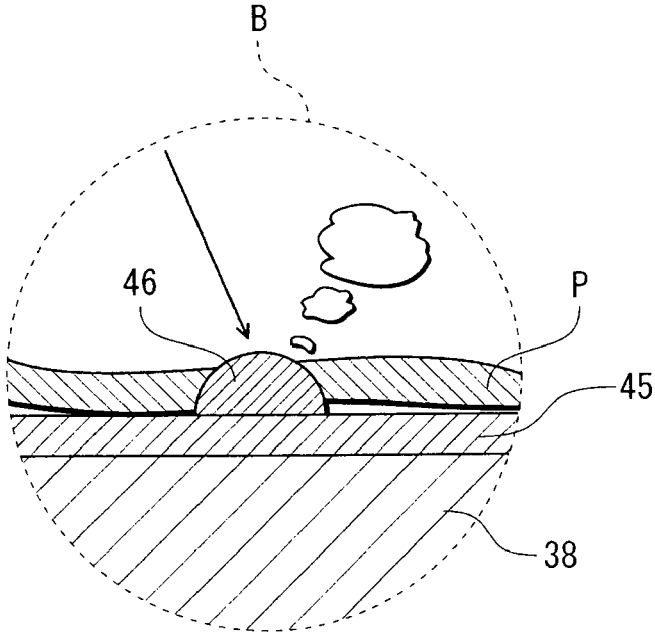

FIGS. 5A and 5B are views useful in explaining a third variation of the cleaning process according to the present embodiment, in which FIG. 5A shows a case where the TMP has an ultraviolet irradiation device, and FIG. 5B is an enlarged view of a portion B shown in FIG. 5A.

As shown in FIG. 5A, the TMP 18 has an ultraviolet irradiation device 44 that is disposed in an upper portion of the interior of the main body 37 and irradiates ultraviolet rays toward foreign matter P attached to the internal surface of the TMP 18, and the ultraviolet irradiation device 44 irradiates the ultraviolet rays toward the foreign matter P. In the present variation, a photocatalytic film 45 is formed on the internal surface of the TMP 18 as shown in FIG. 5B. When the ultraviolet rays are irradiated from the ultraviolet irradiation device 44 toward the foreign matter P, hydroxyl radicals 46 are generated from the photocatalytic film 45 formed on the internal surface of the TMP 18 to which the foreign matter P is attached, and the foreign matter P chemically reacts with the hydroxyl radicals 46 and vaporizes. The vaporized foreign matter P is exhausted out of the TMP 18 by the exhaust stream inside the TMP 18.

According to the present process, because the ultraviolet rays are irradiated toward the foreign matter P attached to the internal surface of the TMP 18 on which the photocatalytic film 45 is formed, the hydroxyl radicals 46 are generated from the photocatalytic film 45 formed on the internal surface of the TMP 18 to which the foreign matter P is attached, and the foreign matter P chemically reacts with the hydroxyl radicals 46 and vaporizes. The vaporized foreign matter P is exhausted out of the TMP 18 by the exhaust stream inside the TMP 18. As a result, the foreign matter P can be removed from the internal surface of the TMP 18, and hence the same effects as those in the cleaning process described above with reference to FIG. 2A can be obtained.

Figure 6A:
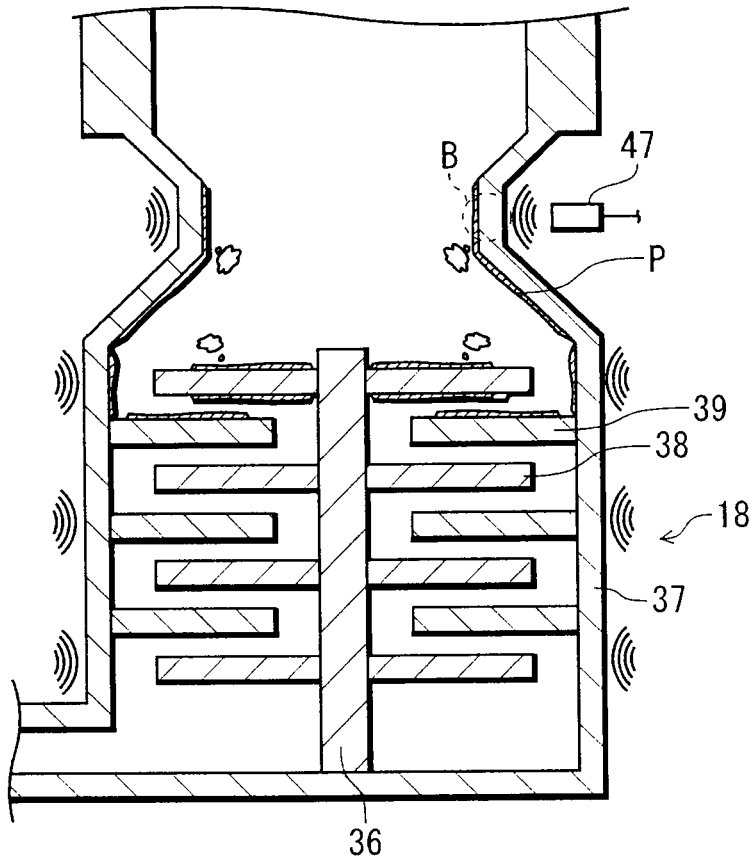
Figure 6B:
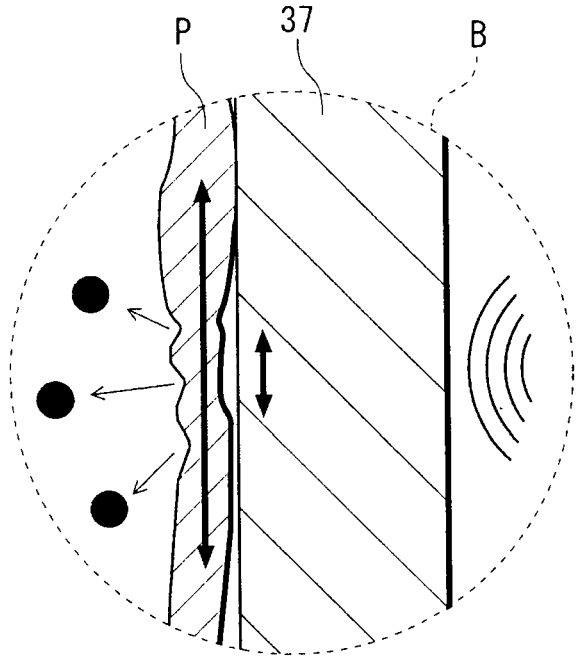

FIGS. 6A and 6B are views useful in explaining a fourth variation of the cleaning process according to the present embodiment, in which FIG. 6A shows a case where the TMP has an electromagnetic wave irradiation device, and FIG. 6B is an enlarged view of a portion B shown in FIG. 6A.

As shown in FIG. 6A, the TMP 18 has an electromagnetic wave irradiation device 47 that irradiates electromagnetic waves toward foreign matter P attached to the internal surface of the TMP 18, and the electromagnetic wave irradiation device 47 irradiates the electromagnetic waves toward the foreign matter P. When the electromagnetic waves are irradiated from the electromagnetic wave irradiation device 47 toward the foreign matter P, the foreign matter P absorbs the electromagnetic waves and generates heat to increase in temperature. Thereafter, when the temperature of the foreign matter P rises to a sublimation point, the foreign matter P vaporizes. The vaporized foreign matter P is exhausted out of the TMP 18 by the exhaust stream inside the TMP 18.

According to the present process, because the electromagnetic waves are irradiated toward the foreign matter P, the foreign matter P absorbs the electromagnetic waves and generates heat. When the temperature of the foreign matter P rises to a sublimation point, the foreign matter P vaporizes. The vaporized foreign matter P is exhausted out of the TMP 18 by the exhaust stream inside the TMP 18. As a result, the foreign matter P can be removed from the internal surface of the TMP 18, and hence the same effects as those in the cleaning process described above with reference to FIG. 2A can be obtained.

Moreover, in the present process, as shown in FIG. 6B, by irradiating the electromagnetic waves toward the foreign matter P, it is possible to produce thermal stress arising from a difference in the coefficient of thermal expansion between the foreign matter P and the internal surface of the TMP 18 to which the foreign matter P is attached, and hence the foreign matter P can be separated from the internal surface of the TMP 18.

Figure 7A:
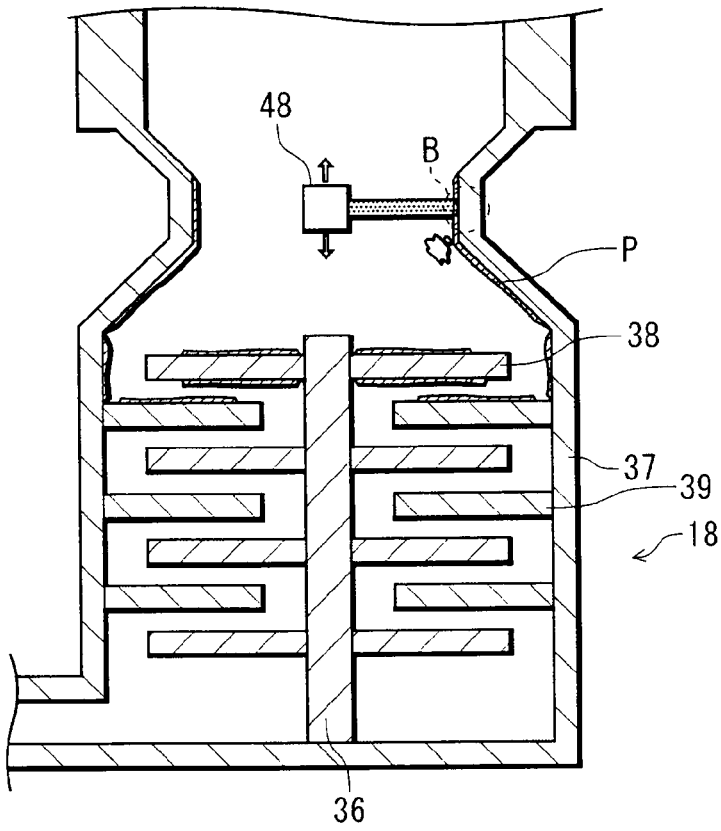
Figure 7B:
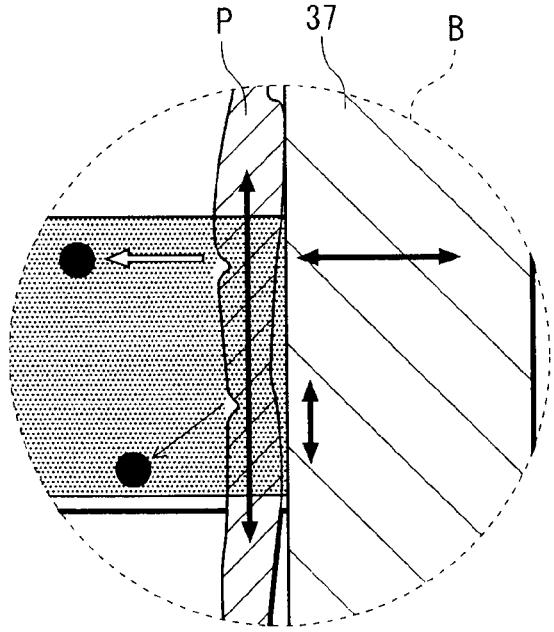

FIGS. 7A and 7B are views useful in explaining a fifth variation of the cleaning process according to the present embodiment, in which FIG. 7A shows a case where the TMP has a laser light irradiation device, and FIG. 7B is an enlarged view of a portion B shown in FIG. 7A.

As shown in FIG. 7A, the TMP 18 has a laser light irradiation device 48 that is disposed in an upper portion of the interior of the main body 37 and irradiates laser light toward foreign matter P attached to the internal surface of the TMP 18, and the laser light irradiation device 48 irradiates the laser light toward the foreign matter P. When the laser light is irradiated from the laser light irradiation device 48 toward the foreign matter P, the foreign matter P is heated by the laser light to increase in temperature. Thereafter, when the temperature of the foreign matter P rises to a sublimation point, the foreign matter P vaporizes. The vaporized foreign matter P is exhausted out of the TMP 18 by the exhaust stream inside the TMP 18.

According to the present process, because the laser light is irradiated toward the foreign matter P, the foreign matter P is heated by the laser light. When the temperature of the foreign matter P rises to a sublimation point, the foreign matter P vaporizes. The vaporized foreign matter P is exhausted out of the TMP 18 by the exhaust stream inside the TMP 18. As a result, the foreign matter P can be removed from the internal surface of the TMP 18, and hence the same effects as those in the cleaning process described above with reference to FIG. 2A can be obtained.

Moreover, in the present process, as shown in FIG. 7B, by irradiating the laser light toward the foreign matter P, it is possible to produce thermal stress arising from a difference in the coefficient of thermal expansion between the foreign matter P and the internal surface of the TMP 18 to which the foreign matter P is attached, and hence the foreign matter P can be separated from the internal surface of the TMP 18. Further, the internal surface of the TMP 18 can be rapidly expanded in a horizontal direction as viewed in the drawing by rapidly heating the internal surface of the TMP 18 through the laser light, and hence kinetic energy in a direction indicated by the outline arrow in the drawing can be applied to the foreign matter P attached to the internal surface of the TMP 18, whereby the foreign matter P can be separated from the internal surface of the TMP 18.

In the present process, it is preferred that the laser light irradiated from the laser light irradiation device 48 is high-power laser light. Moreover, if laser light of wavelengths in the infrared region or the visible region is used, the above described thermal stress can be reliably produced. Further, if laser light of wavelengths in the ultraviolet region is used, the above described kinetic energy can be reliably applied to the foreign matter P.

Figure 8:
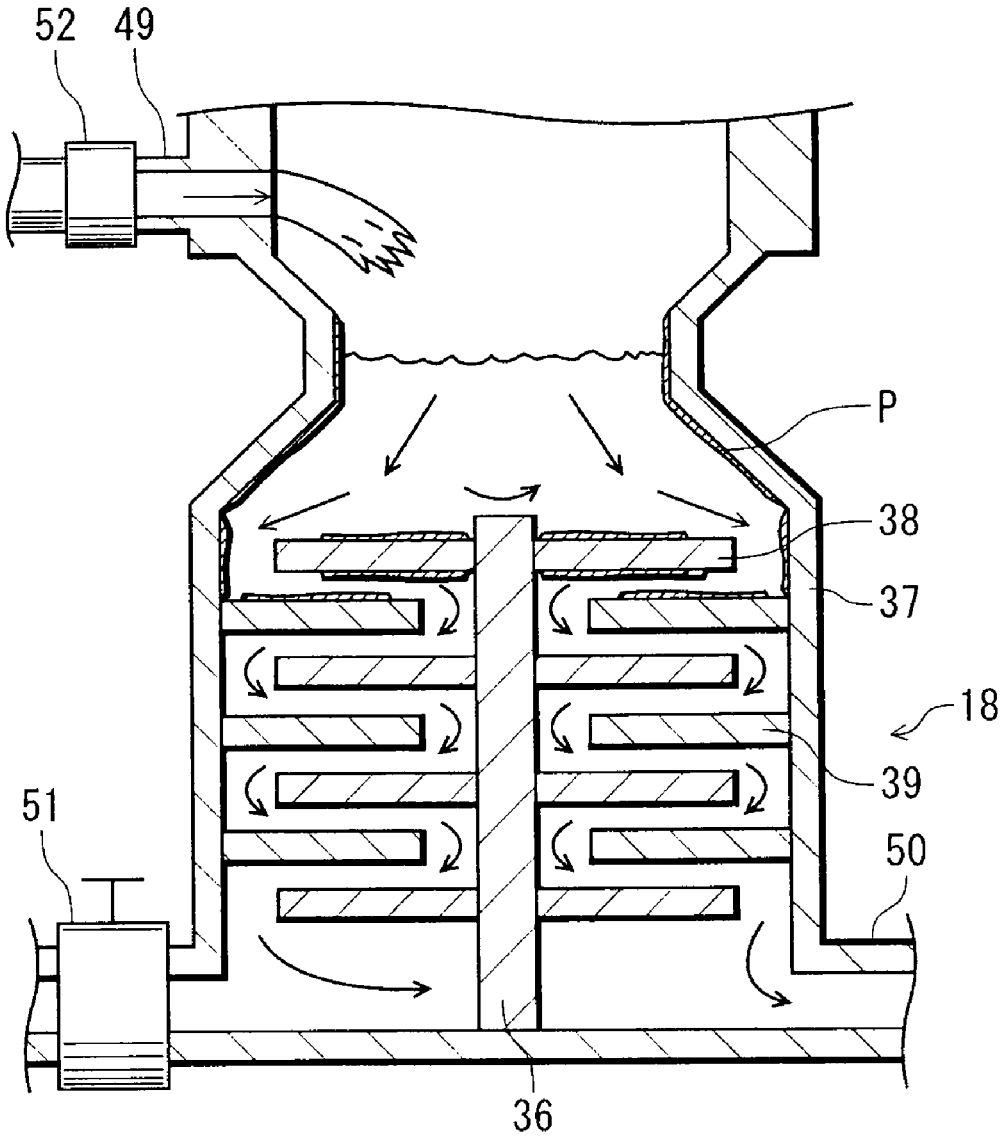
FIG. 8 is a view useful in explaining a sixth variation of the cleaning process according to the present embodiment.

FIG. 8 is a view useful in explaining a sixth variation of the cleaning process according to the present embodiment.

As shown in FIG. 8, the TMP 18 has a cleaning fluid inflow path 49 that is formed in an upper portion of the interior of the main body 37, a cleaning fluid outflow path 50 that is formed in a lower portion of the main body 37, and a valve 51 that is disposed downstream of the TMP 18. The cleaning fluid inflow path 49 is connected to a cleaning fluid supply source (not shown) via a cleaning fluid vibrating device 52. In the TMP 18, after the valve 51 is closed, a cleaning fluid that has been supplied from the cleaning fluid supply source via the cleaning fluid inflow path 49 and to which predetermined vibrations have been applied by the cleaning fluid vibrating device 52 is flown into the TMP 18. When the cleaning fluid is flown into the TMP 18, foreign matter P is caused to separate from the internal surface of the TMP 18 by the cleaning fluid. The separated foreign matter P as well as the cleaning fluid flown into the TMP 18 is exhausted through the cleaning fluid outflow path 50.

According to the present process, because the cleaning fluid is flown into the TMP 18, the foreign matter P is caused to separate from the internal surface of the TMP 18 by the cleaning fluid. The separated foreign matter P as well as the cleaning fluid flown into the TMP 18 is exhausted through the cleaning fluid outflow path 50. As a result, the foreign matter P can be removed from the internal surface of the TMP 18, and hence the same effects as those in the cleaning process described above with reference to FIG. 2A can be obtained.

In the present process, it is preferred that a highly-volatile cleaning fluid is used so as to accelerate drying of the interior of the TMP 18 after the cleaning fluid is exhausted out of the TMP 18. Also, the interior of the TMP 18 may be heated so as to accelerate drying of the interior of the TMP 18.

Figure 9:
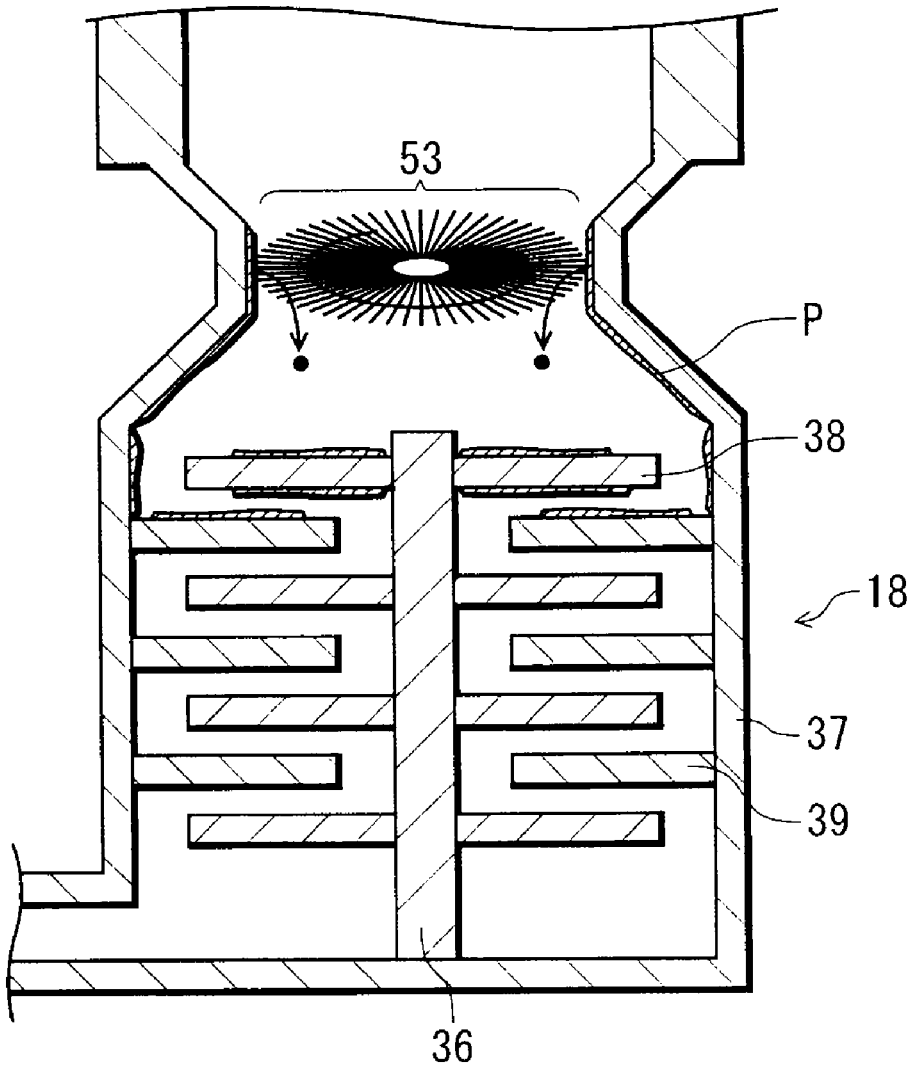
FIG. 9 is a view useful in explaining a seventh variation of the cleaning process according to the present embodiment.

FIG. 9 is a view useful in explaining a seventh variation of the cleaning process according to the present embodiment.

As shown in FIG. 9, the TMP 18 has a brush 53 that is disposed in an upper portion of the interior of the main body 37 and scrubs foreign matter P attached to the internal surface of the TMP 18, and the brush 53 scrubs the foreign matter P. When the foreign matter P is scrubbed by the brush 53, the foreign matter P separates from the internal surface of the TMP 18. The separated foreign matter P is exhausted out of the TMP 18 by the exhaust stream inside the TMP 18.

According to the present process, because the foreign matter P is scrubbed by the brush 53, the foreign matter P separates from the internal surface of the TMP 18. The separated foreign matter P is exhausted out of the TMP 18 by the exhaust stream inside the TMP 18. As a result, the foreign matter P can be removed from the internal surface of the TMP 18, and hence the same effects as those in the cleaning process described above with reference to FIG. 2A can be obtained.

It should be noted that the brush 53 disposed in the upper portion of the interior of the main body 37 is housed in a housing chamber (not shown) connected to the upper portion of the interior of the main body 37 while the RIE processing is carried out on a wafer W housed in the chamber 11.

Figure 10A:
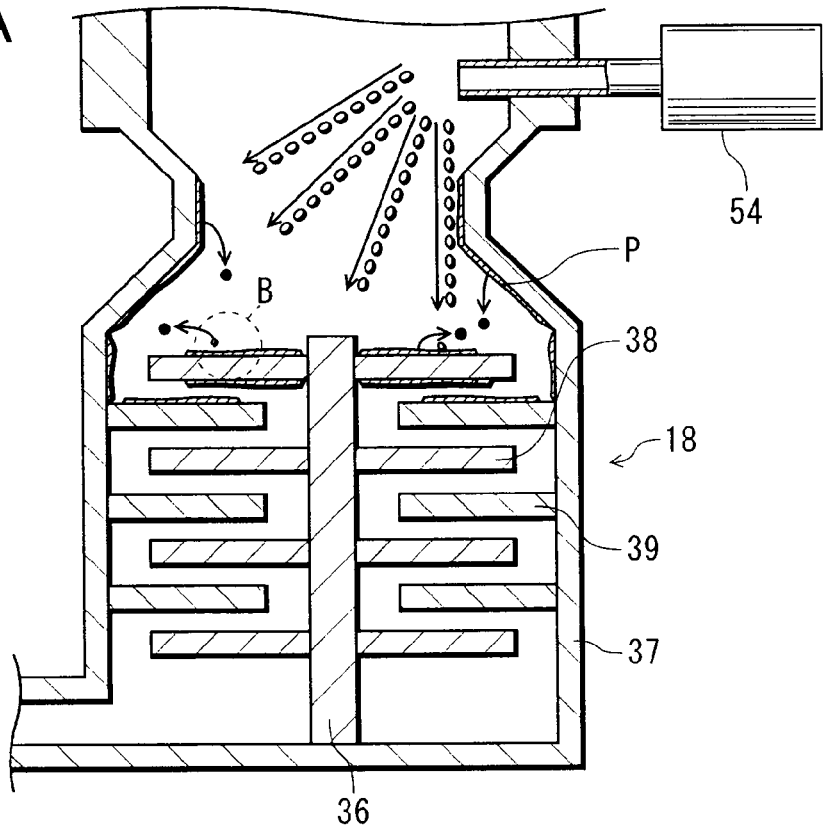
Figure 10B:
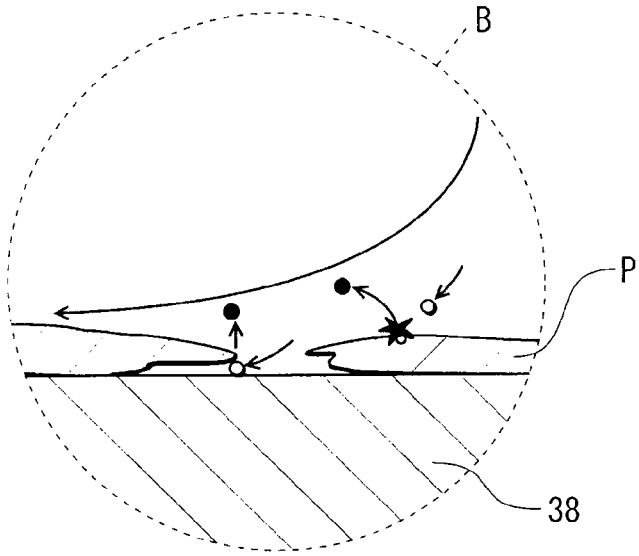

FIGS. 10A and 10B are views useful in explaining an eighth variation of the cleaning process according to the present embodiment, in which FIG. 10A shows a case where the TMP has an aerosol jetting device, and FIG. 10B is an enlarged view of a portion B shown in FIG. 10A.

As shown in FIG. 10A, the TMP 18 has an aerosol jetting device 54 that is disposed in an upper portion of the interior of the main body 37 and jets an aerosol (mixture), in which a substance in gaseous form and a substance in one or both of liquid form and solid form are mixed, toward foreign matter P attached to the internal surface of the TMP 18, and the aerosol jetting device 54 jets the aerosol toward the foreign matter P. When the aerosol is jetted toward the foreign matter P from the aerosol jetting device 54, the foreign matter P is caused to separate from the internal surface of the TMP 18 by viscous force of the substance in gaseous form in the aerosol, impact force of the substance in one or both of liquid form and solid form, and lifting force that is produced when the substance in one or both of liquid form and solid form sublimes between the foreign matter P and the internal surface of the TMP 18. The separated foreign matter P is exhausted out of the TMP 18 by the exhaust stream inside the TMP 18.

According to the present process, because the aerosol is jetted toward the foreign matter P, the foreign matter P is caused to separate from the internal surface of the TMP 18 by viscous force of the substance in gaseous form in the aerosol, impact force of the substance in one or both of liquid form and solid form, and lifting force that is produced when the substance in one or both of liquid form and solid form sublimes between the foreign matter P and the internal surface of the TMP 18. The separated foreign matter P is exhausted out of the TMP 18 by the exhaust stream inside the TMP 18. As a result, the foreign matter P can be removed from the internal surface of the TMP 18, and hence the same effects as those in the cleaning process described above with reference to FIG. 2A can be obtained.

In the present process, it is preferred that the aerosol jetted from the aerosol jetting device 54 is generated from an inert gas such as nitrogen gas, argon gas, carbon dioxide gas, or mixed gas of nitrogen gas and argon gas.

Moreover, in the present process, the internal surface of the TMP 18 may be heated before the aerosol is jetted from the aerosol jetting device 54. In this case, the foreign matter P can be reliably separated from the internal surface of the TMP 18 due to a difference in volume change caused by heat shrink between the internal surface of the TMP 18 and the foreign matter P that has been cooled by the jetted aerosol.

Figure 11:
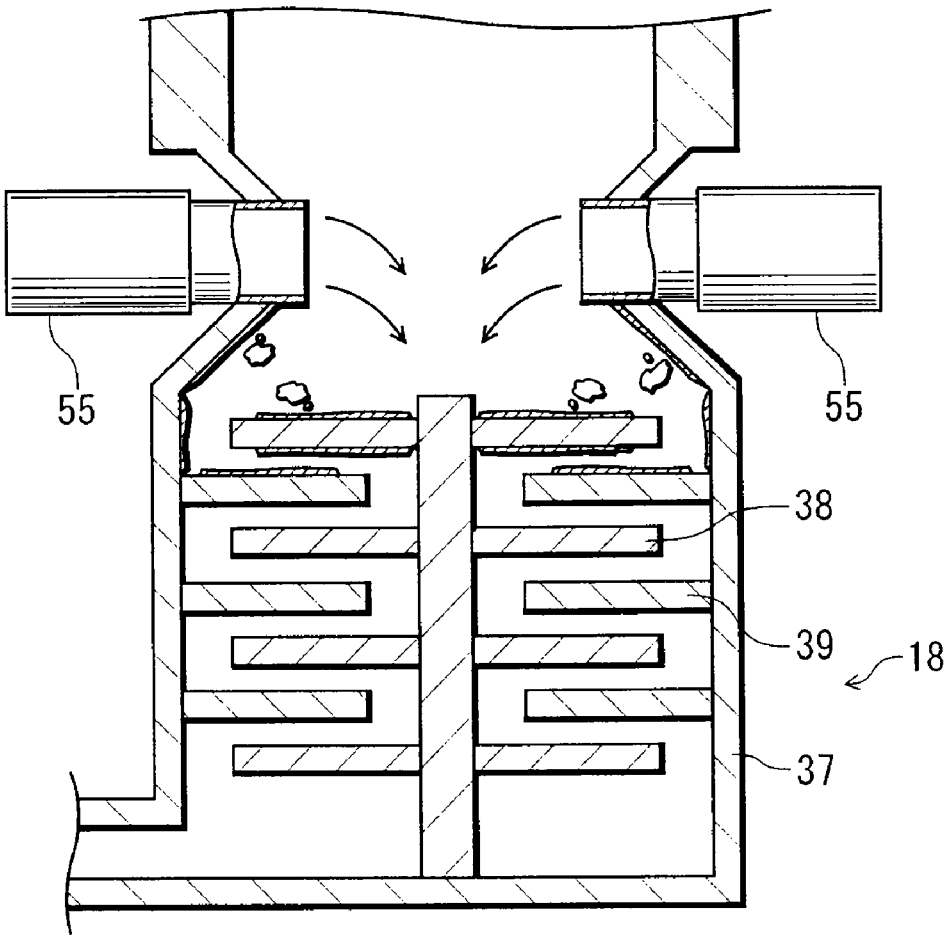
FIG. 11 is a view useful in explaining a ninth variation of the cleaning process according to the present embodiment.
Figure 12A:
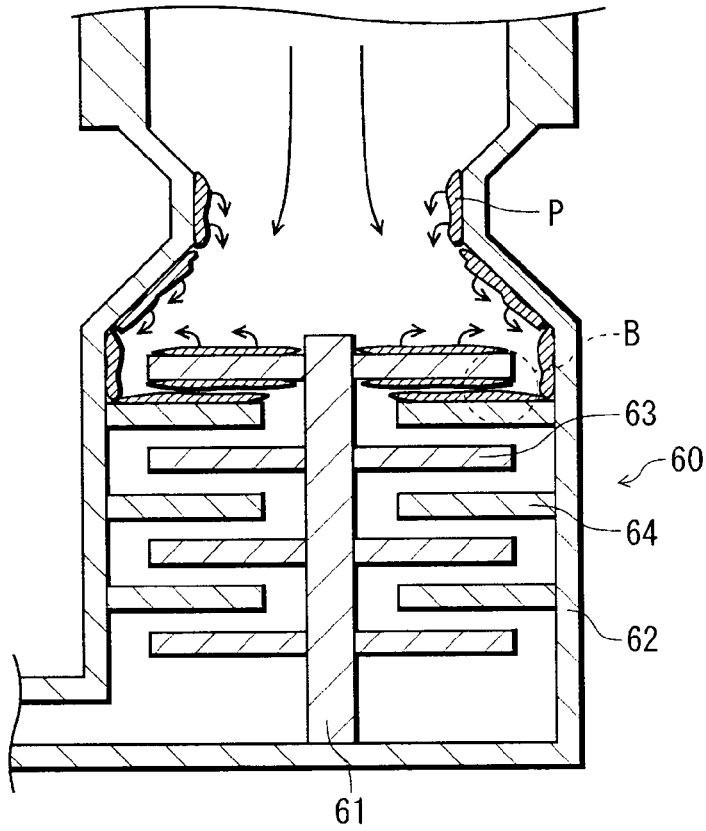
Figure 12B:
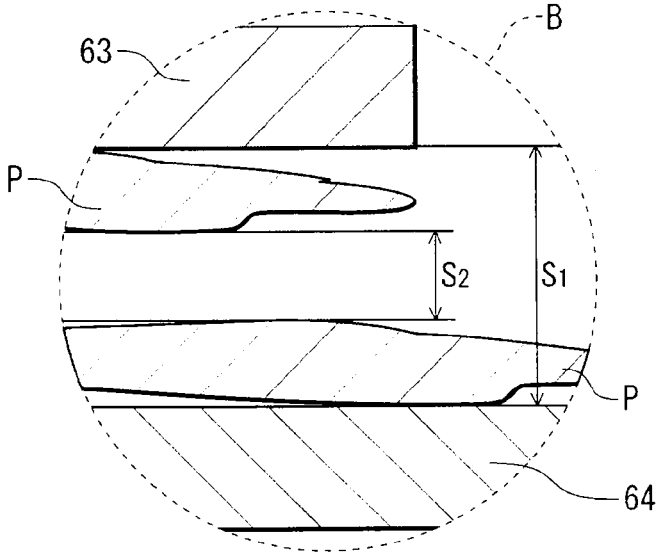

FIG. 11 is a view useful in explaining a ninth variation of the cleaning process according to the present embodiment.

As shown in FIG. 11, the TMP 18 has a radical supply device 55 that is disposed in an upper portion of the interior of the main body 37 and supplies radicals toward foreign matter P attached to the internal surface of the TMP 18, and the radical supply device 55 supplies the radicals toward the foreign matter P. When the radicals are supplied from the radical supply device 55 toward the foreign matter P, the foreign matter P chemically reacts with the radicals and vaporizes. The vaporized foreign matter P is exhausted out of the TMP 18 by the exhaust stream inside the TMP 18.

According to the present process, because the radicals are supplied toward the foreign matter P, the foreign matter P chemically reacts with the radicals and vaporizes. The vaporized foreign matter P is exhausted out of the TMP 18 by the exhaust stream inside the TMP 18. As a result, the foreign matter P can be removed from the internal surface of the TMP 18, and hence the same effects as those in the cleaning process described above with reference to FIG. 2A can be obtained.

In the present process, it is preferred that the radical supply device 55 supplies oxygen radicals or fluorine radicals as the radicals. Because oxygen radicals and fluorine radicals are highly reactive, the foreign matter P can be reliably vaporized. Also, it is preferred that oxygen gas is used as a gas for generating oxygen radicals, and nitrogen trifluoride gas or sulfur hexafluoride gas is used as a gas for generating fluorine radicals.

In the above described embodiments, the substrate processing apparatus is an etching processing apparatus as a semiconductor device manufacturing apparatus, the apparatus to which the present invention may be applied is not limited to this, but may be another semiconductor device manufacturing apparatus using plasma, such as a deposition apparatus using CVD (chemical vapor deposition) or PVD (physical vapor deposition). Further, the present invention may be applied to an evacuation processing apparatus using a TMP such as an ion implantation processing apparatus, a vacuum transfer apparatus, a thermal treatment apparatus, an analyzing apparatus, an electron accelerator, an FPD (flat panel display) manufacturing apparatus, a solar cell manufacturing apparatus, an etching processing apparatus as a physical quantity analyzing apparatus, or a deposition processing apparatus.

Further, although in the above described embodiments, the substrates to be processed are semiconductor wafers, this is not limitative, but the substrates to be processed may instead be any of various glass substrates used in LCDs (Liquid Crystal Displays), FPDs (Flat Panel Displays) or the like.

What is claimed is:

1. A cleaning method for a turbo molecular pump connected to a processing chamber of a substrate processing apparatus, comprising:

a vaporizing gas supplying step of supplying toward foreign matter attached to an internal surface of the turbo molecular pump a vaporizing gas including both ozone gas and hydrogen gas.

2. A cleaning method as claimed in claim 1, wherein said vaporizing gas supplying step comprises an ultraviolet irradiation step of irradiating ultraviolet rays toward the foreign matter.

3. A cleaning method for a turbo molecular pump connected to a processing chamber of a substrate processing apparatus, the turbo molecular pump having a shock wave producing device disposed in an upper portion of the interior of a main body thereof, the cleaning method comprising:

a shock wave producing step of, by the shock wave producing device, producing shock waves that propagate toward foreign matter attached to an internal surface of the turbo molecular pump.

4. A cleaning method as claimed in claim 3, wherein in said shock wave producing step, a predetermined gas is supplied at a supersonic speed.

5. A cleaning method as claimed in claim 4, wherein the predetermined gas is a high-temperature gas.

6. A cleaning method as claimed in claim 4, wherein the predetermined gas is a water vapor-containing gas containing water vapor.

7. A cleaning method for a turbo molecular pump connected to a processing chamber of a substrate processing apparatus, comprising:

a brushing step of scrubbing foreign matter attached to an internal surface of the turbo molecular pump using a brush, wherein the turbo molecular pump has a housing chamber connected to the upper portion of the interior of a main body thereof, and the brush is housed in the housing chamber while plasma processing is carried out on a substrate housed in a processing chamber of the substrate processing apparatus.

* * * * *